United States Patent [19]

Amano

[11] Patent Number: 4,562,434

[45] Date of Patent: Dec. 31, 1985

[54] PLASMA DISPLAY PANEL

[75] Inventor: Yoshifumi Amano, Kamakura, Japan

[73] Assignee: Sony Corporation, Tokyo, Japan

[21] Appl. No.: 399,799

[22] Filed: Jul. 19, 1982

[30] Foreign Application Priority Data

Aug. 17, 1981 [JP] Japan ..... 56-128470

[51] Int. Cl.[4] ..... G09G 3/28

[52] U.S. Cl. ..... 340/775; 340/771; 340/779; 315/169.4

[58] Field of Search ..... 340/775, 779, 776, 777, 340/771, 811; 315/169.4

[56] References Cited

U.S. PATENT DOCUMENTS

| | | | |
|---|---|---|---|
| 3,886,404 | 5/1975 | Kurahashi et al. | 340/779 |
| 3,989,974 | 11/1976 | Tottori et al. | 315/169.4 |
| 3,990,068 | 11/1976 | Mayer et al. | 340/775 |
| 4,005,402 | 1/1977 | Amano | 340/779 |
| 4,044,349 | 8/1977 | Andoh et al. | 340/775 |

*Primary Examiner*—Gerald L. Brigance

*Attorney, Agent, or Firm*—Hill, Van Santen, Steadman & Simpson

[57] ABSTRACT

A flat panel display device which has first and second insulating plates with at least one of the plates being transparent and a first plurality of parallel extending electrodes mounted on one side of the first plate and at least a second electrode mounted on one side of the second plate and covered with an insulating layer and a third plurality of parallel extending electrodes mounted on the insulating layer at a predetermined angle to the first electrodes with the first electrodes being spaced from and opposed to the third electrodes so as to define a cross-conductor matrix and a plurality of parallel insulating barriers mounted between the first electrodes and trigger and sequence pulses connected to the various electrodes so as to produce display signals so as to substantially reduce the number of driving electrodes required and also to reduce the driving voltages.

14 Claims, 20 Drawing Figures

PLASMA DISPLAY PANEL

BACKGROUND OF THE INVENTION

1. Field of the Invention

This invention relates in general to a discharge display device and in particular to an improved display device which requires fewer leads and/or allows lower voltages to be utilized.

2. Description of the Prior Art

Discharge display panels utilizing X-Y matrices are known for displaying characters or figures. FIG. 1 illustrates a partially sectional view of a display device of the prior art in perspective with a conventional X-Y matrix discharge display panel (of the plasma display type panel PDP). FIG. 2 comprises a cross-sectional view of the structure of FIG. 1. The discharge display panel has a face plate 1 and a rear plate 2 and anodes 3 are mounted parallel to each other and cathodes 4 are arranged parallel to each other and extend at 90° to the anodes 3 and the arrangement provides an X-Y matrix between the face plate 1 and the rear plate 2. The anodes 3 are separated by barrier ribs 5 and the anodes 3 and the cathode 4 are driven by AC or DC voltages. The number of leads required for driving the anodes and cathodes comprises the sum n of the anodes (X electrodes) and the number m of cathodes (Y electrodes) and thus the number of driving electrodes is very large. This results in high cost of the device.

FIG. 3 is a partially broken away perspective view of a self-scanned type discharge display panel which is known as a display panel of the Burroughs-type. This display panel has scan electrodes 6 embedded below the cathodes 4 in addition to the anodes 3 and the cathodes 4 which are arranged in the X-Y matrix. The trigger discharge between the scan electrode 6 and the cathodes 4 is line sequentially among the cathodes 4 and is transferred by self-scan. The display signals are thus applied to the anodes 3. According to the matrix intersections determined by the display signals thus obtained and by self-scan the trigger discharge is guided to the display regions comprising the display cells for display.

The self-scanning trigger discharge may not jump between adjacent cathodes 4. Due to this fact, in a discharge display panel of this type, the cathodes at stated intervals are commonly connected into a plurality of groups and the individual groups are sequentially driven. For this reason, the number of driving electrodes need be only one for each of the cathode groups which results in simplification of the overall circuitry. However, this advantage requires a much more complex structure for the display panel.

SUMMARY OF THE INVENTION

It is an object of the present invention to provide a discharge display device which eliminates the drawbacks of the conventional discharge display devices of the prior art.

It is an object of the invention to substantially reduce the number of driving leads required for display panel.

It is another object of the present invention to reduce the driving voltage required for a discharge display panel so that the insulation and construction of the discharge display panel can be simpler and less expensive than prior art devices since it need not withstand the higher voltages required in the prior art structures.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
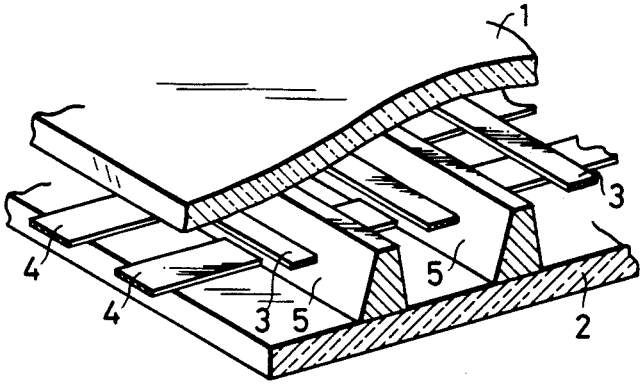
FIG. 1 PRIOR ART
FIG. 1 is a perspective broken away drawing illustrating a conventional X-Y matrix discharge display panel.
Figure 2:
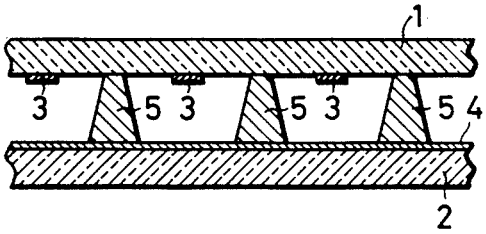
FIG. 2 PRIOR ART
FIG. 2 is a cross-sectional view of the panel illustrated in FIG. 1.
Figure 3:
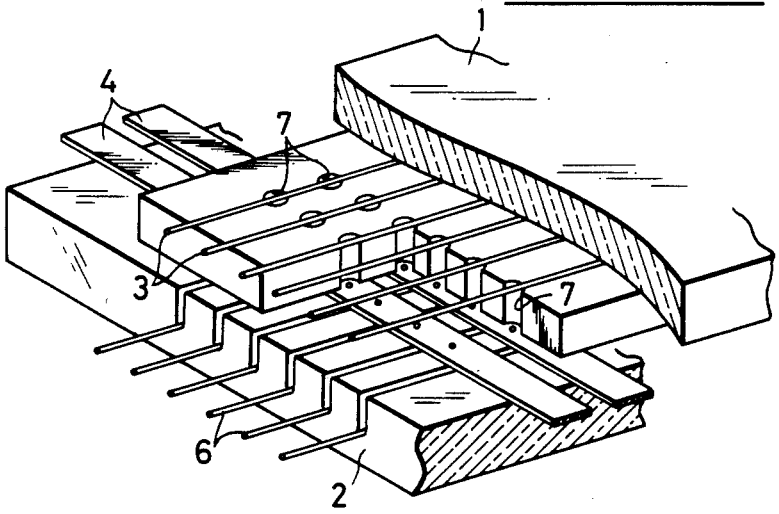
FIG. 3 PRIOR ART
FIG. 3 is a perspective view of a conventional self-scan type discharge display panel.
Figure 4:
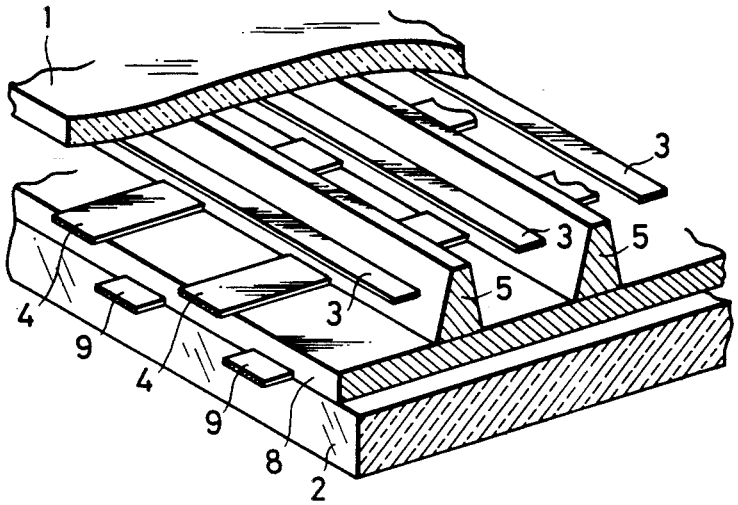
FIG. 4 is a partially broken, perspective view of the discharge display panel according to the present invention.
Figure 5:
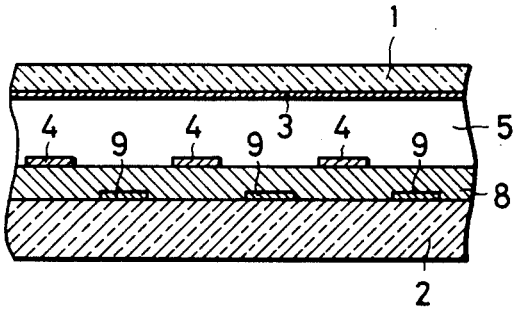
FIG. 5 is a cross-sectional view of the panel illustrated in FIG. 4.

FIG. 4 is a partially broken away perspective view of a discharge display panel according to the invention and FIG. 5 is a cross-sectional view of the invention illustrated in FIG. 4. The discharge display panel illustrated in FIG. 4 has a face plate 1, a rear plate 2 and a plurality of parallel electrodes 3 which extend in the X direction and a plurality of parallel mounted cathodes 4 which extend in the Y direction so as to form an X-Y matrix. The anodes 3 are separated by parallel mounted barrier ribs 5. A plurality of electrodes 9 extend in the Y direction and are separated from the cathodes 4 by an insulating layer 8. The trigger electrodes 9 are laterally offset from the cathodes 4 as illustrated in FIG. 5 so that there is one trigger electrode 9 between each pair of adjacent cathodes.

In manufacturing the discharge display panel of the invention screen printing techniques or vapor deposition techniques can be utilized. For example, the trigger electrodes 9 can be formed on the rear plate 2 by using screen printing processes. The insulating layer 8 is then formed over the trigger electrodes 9 and the rear plate 2 by printing, coating, or adhesion techniques. The cathodes 4 are formed by a screen printing process on the top of the insulating layer 8 and the anodes 3 are formed on the inner surface of the face plate 1 by using screen printing process. The face plate 1 and the rear plate 2 are then mounted superposed parallel to each other with the barrier ribs 5 between so that the anodes 3 and the cathodes 4 form the X-Y matrix. The plates are sealed together in conventional fashion to form the complete discharge display panel with conventionally the air being evacuated and a suitable gas beam inserted into the envelope thus formed.

If the cathodes 4 are formed to have a 0.2 mm pitch, the trigger electrodes 9 may be arranged to have the same pitch. The tolerance of the difference in the relative positions of the cathodes and the trigger electrodes is relatively large. In other words, a slight difference in the relative positions of the cathodes and their trigger electrodes will not result in malfunctioning of the trigger electrodes. The anodes 3 and the cathodes 4 may be formed by a screen printing process using a low melting glass paste containing nickel powder. The insulating layer 8 may be formed using screen printing processes of a low melting glass paste. The discharge display panels can be manufactured by the screen printing technique with high yield at relatively low cost.

Another example of constructing the panel, a transparent electrically conductive film of tin oxide $SnO_2$ the indium oxide $InO_2$ is formed on the surface of the back plate 2 by a vapor deposition or the like and this film is etched to form the trigger electrodes 9. The insulating layer 8 is formed over the electrodes 9 by printing coating or adhesion. Then the cathodes 4 are formed on the insulating layer 8 by screen printing processes.

The anodes 3 are formed on the inner surface of the face plate 1 using a screen printing process. The face plate 1 and the rear plate 2 are superimposed on each other with barrier ribs 5 therebetween and the envelope is sealed to complete the discharge display panel illustrated in FIG. 4 in a conventional manner. For this structure, the rear plate 2 will be the front side of the panel and the discharge display can be viewed through the transparent scan plate 2, the trigger electrodes 9 and the insulating layer 8.

When discharge display panels are manufactured by this method, the discharge at the surface of the cathode comprises the display which is observed. Thus, as compared to the method of manufacturing first described the barrier ribs 5 will not interfere with observation of the display when the display is obliquely observed. Thus, the display is not subject to directivity for obtaining display effects.

Although the cathodes may comprise transparent electrodes, they may alternatively comprises Ni electrodes. In this case, since the cathodes are mounted with a 0.2 mm pitch, they can be as small as 0.1 mm in width. Thus, observation of the discharge display will not be disturbed by the cathodes.

Figure 6:
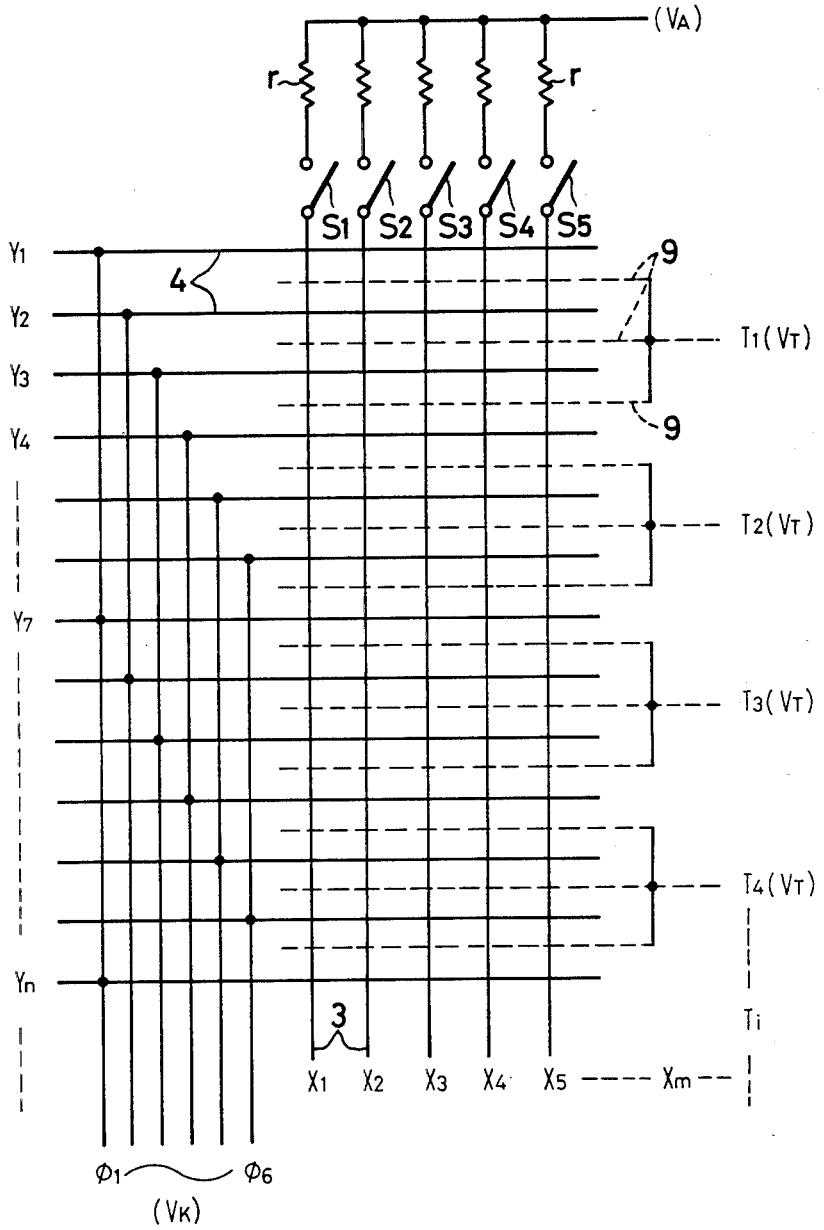
FIG. 6 is an electrical schematic diagram of the discharge display panel illustrated in FIG. 4.
Figure 7A:
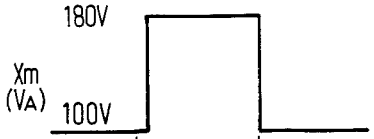
FIGS. 7A, B and C illustrate waveforms of the drive voltages of the circuit illustrated in FIG. 6.
Figure 7B:
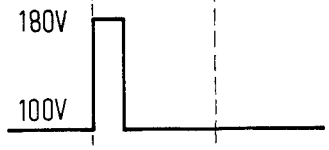
Figure 7C:
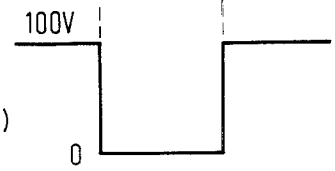

FIG. 6 is an electrical schematic circuit diagram for operating the discharge display panel of the invention illustrated in FIGS. 4 and 5. FIG. 7A through 7C illustrated wave forms for the drive voltage signals. As illustrated in FIG. 6, a pulsed anode voltage $V_A$ (which can be 100 Volts at its low level and 180 volts at its high level) as illustrated in FIG. 7A and applied as a voltage $X_m$ which is applied to the anodes 3 through resistors r and switches $S_1$ through $S_5$. The swtiches $S_1$, $S_2$–$S_n$ are opened and closed parallel to each other depending upon the required display. Every sixth cathode 4, for example, are commonly connected together to form six groups of cathodes with leads $\phi_1$ through $\phi_6$. These groups of cathodes $\phi_1$ through $\phi_6$ are sequentially driven by sequence pulses having horizontal scanning periods (Y scanning) with a cathode voltage $V_K$ (0 volts at its lowest level and 100 volts at its highest level). The voltage $Y_n$ ($V_K$) is illustrated in FIG. 7C. The values of the anode voltage $V_A$ and the cathode voltage $V_K$ may be the same as those used for conventional discharge display panels.

Three adjacent trigger electrodes 9 are commonly connected together to form groups of trigger electrodes $T_1$, $T_2$ and so forth as illustrated in FIG. 6. Each of these groups of trigger electrodes is driven by trigger pulses of horizontal scanning period by a trigger voltage $V_T$ ($T_i$) as illustrated in FIG. 7B. In FIG. 7B, the trigger pulses are sequentially applied to the groups of trigger electrodes for a period which is three times that of the horizontal scanning period.

Figure 8A:
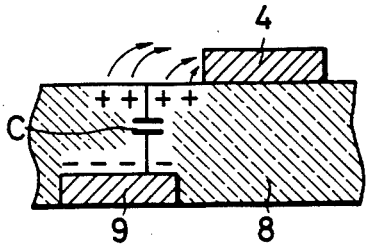
FIGS. 8A and 8B are enlarged sectional views of the invention.
Figure 8B:
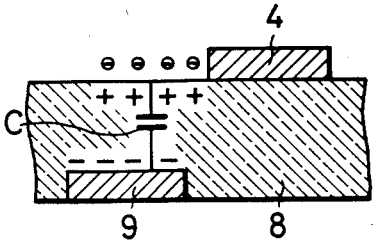
Figure 9:
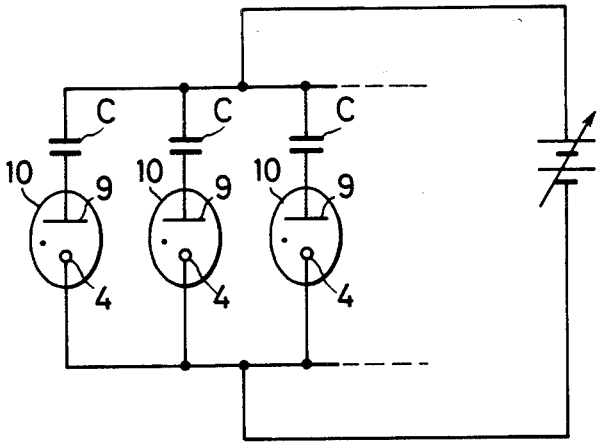
FIG. 9 is an equivalent circuit of the discharge elements consisting of the trigger electrodes and cathodes.

FIGS. 8A and 8B comprise enlarged partial cross-sectional views for explaining the discharge between the cathodes 4 and the trigger electrodes 9. FIG. 9 is an equivalent circuit diagram of the cathodes 4 and the trigger electrodes 9. As illustrated in FIGS. 8A and 8B, the insulating layer 8 is mounted between the cathodes 4 and the trigger electrodes 9. Thus, these electrodes are capacitively coupled. As shown in the equivalent circuit diagram of FIG. 9, discharge elements 10 have anodes and cathodes which correspond to the trigger electrodes 9 and the cathode electrodes 4.

When the cathode voltage $V_K$ (0 volts) is applied to a cathode group $Y_n$ and the trigger voltage $V_T$ (plus 180 volts) is applied to a group of trigger electrodes $T_i$, the potential difference of 180 volts will be established between them so as to initiate the discharge operation. Such discharge will stop immediately after the capacitors C are charged.

As shown in FIG. 6, when the trigger voltage $V_T$ (plus 180 volts) is applied to the trigger electrode group $T_1$ and the first sequence pulse of the cathode voltage $V_K$ (0 volts) is applied to the group $\phi_1$ which includes the Y electrode $Y_1$, temporary discharge will occur along the cathode 4 longitudinally as indicated by the arrows illustrated in FIG. 8A. However, the electric field thus generated will be cancelled by the negative charge on the surface of the insulating layer 8 as illustrated in FIG. 8B and the temporary discharge will stop.

However, due to the temporary discharge, the space in the vicinity of the Y electrode $Y_1$, will be filled with charged particles. Thus, this cathode will more easily cause discharge than the other Y electrodes.

When one or more of the anode switches $S_1$, $S_2$–$S_n$ are closed, the anodes or X electrodes will be turned on during this condition according to the display signals and the anode voltage $V_A$ (plus 180 volts) will be applied to the selected X electrode $X_n$. Of all of the Y electrodes $Y_1$, $Y_7$, $Y_{13}$ and so forth of the group $\phi_1$ to which the cathode voltage $V_K$ (0 volts) has been applied the discharge will occur only at the Y electrode $Y_1$. Once discharge occurs at the Y electrode $Y_1$, the potential at the X electrode $X_m$ will be lowered to a value below the discharge start voltage and above the discharge maintaining voltage due to the voltage drop across the resistors r. Therefore, discharge will not occur at the remaining Y electrodes $Y_7$, $Y_{13}$ and so forth. Thus, the signal applied to the X electrodes $X_m$ will be displayed only at the Y electrode $Y_1$. The negative charge induced in the discharge gap during the triggered discharge is neutralized by the main discharge between the anodes 3 and the cathodes 4.

In this manner, the Y electrodes which are capable of discharge operations are selected in a line sequential order by the sequence pulses of the cathode voltage $V_K$ which have six different phases and the trigger pulses of the trigger voltage $V_T$. The display signals are applied to the X electrodes to display the data or information on the X-Y matrix. Since the discharge operation of the trigger electrodes is only temporary, it may not be visually observed and thus the contrast of the display will not be degraded. Also, since the display discharge between the X and Y electrodes occurs by triggering, the anode voltage may be lower than in the prior art devices. Thus, the drive circuit for the anodes may be manufactured at low cost. The static delay time of discharge may be shortened and may be made uniform. Also, the display response may be improved and the flicker interference may be eliminated.

As shown in FIG. 6, the pulses of the cathode voltages having six different phases are applied to the Y electrodes 4. Groups of adjacent three trigger electrodes 9 are commonly connected and this is just one-half of the number of cathode electrodes 4 as are connected. Such an arrangement prevents erroneous discharges. If the pulses of three different phases are applied to the Y electrodes 4, the Y electrode $Y_4$ between the groups $T_1$ and $T_2$ of the trigger electrodes is triggered by the group $T_1$ when the Y electrode $Y_1$ is connected to driving voltage. So as to prevent this erroneous discharge operation, the ratio of the number of phases of the voltages applied to the Y electrode to the number of phases applied to the trigger electrode within one group is maintained at 2:1 thus preventing erroneous discharge operation of the Y electrodes as, for example, electrode $Y_7$ at the boundary between the phases of the voltages applied to the Y electrodes.

When a circuit such as illustrated in FIG. 6 is utilized, the drive elements for scanning in the Y direction must generally have a number of (j+i) where j is the number of phases of the voltage which is applied to the Y electrodes and i is the total number of groups of trigger electrodes. If two groups of trigger electrodes are arranged for each group of the Y electrodes consisting of j-phases as illustrated in FIG. 6 the total number n of the Y electrodes may be obtained from the formula:

$$n = j \times i/2$$

Therefore, the sum (j+i/2) or the number (j+i) of the drive elements can be minimized if the following approximation is satisfied:

$$\sqrt{n} \approx j \approx i/2$$

In a display panel having 512 Y electrodes where n=512, $\sqrt{512} \approx 23$. Thus, the substitution of 46 in i or the number of groups of trigger electrodes in the above relationship gives 23+46=69 as the number of drive elements. This is about 1/7 the number of the Y electrodes in prior devices.

Figure 10:
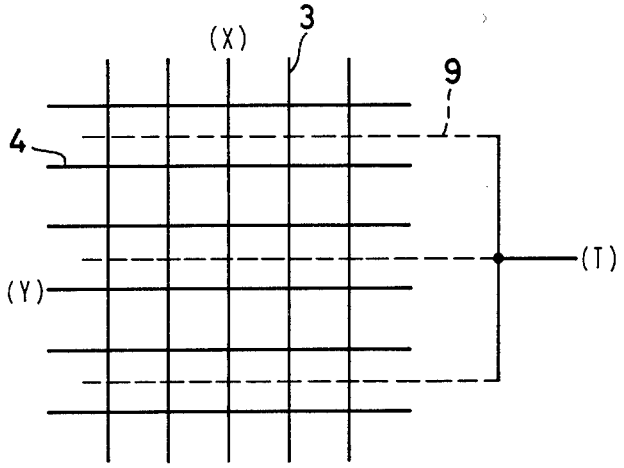
FIG. 10 is a schematic plan view illustrating a modification of the trigger electrodes.

In the above embodiment, the cathodes 4 and the trigger electrodes 9 have a one-to-one relationship. However, it is possible as illustrated in the embodiment of FIG. 10 for the trigger electrodes 9 to be arranged with one trigger electrode 9 for each two cathodes 4. In this arrangement, three adjacent trigger electrodes 9 are connected together to form one group T as shown and the one group T serves six of the cathodes 4.

Figure 11:
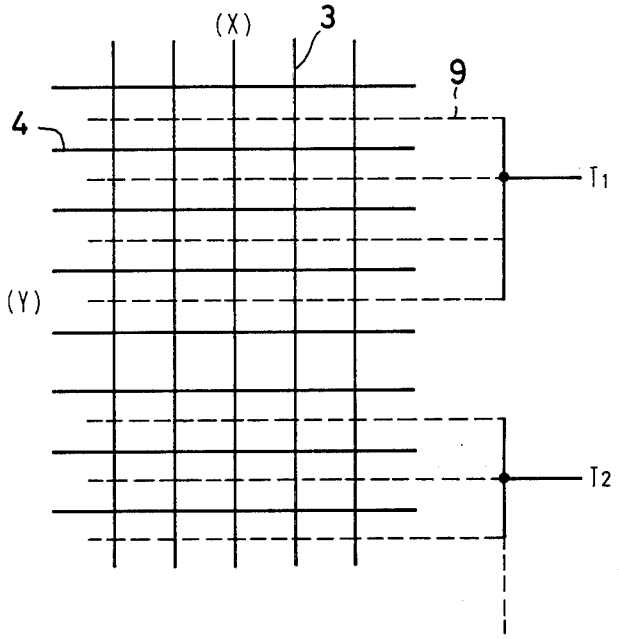
FIG. 11 is a schematic plan view illustrating another modification of the trigger electrodes.

FIG. 11 illustrates an embodiment wherein adjacent groups of the trigger electrodes $T_1$ and $T_2$ are separated by a separation band wherein a trigger electrode 9 does not extend between adjacent cathodes 4 between the groups $T_1$ and $T_2$. In this arrangement, one group of the Y electrodes receive pulses which have plural different phases that correspond to one group of the trigger electrodes. Then since two groups of trigger electrodes need not be arranged to correspond with one group of the Y electrodes as illustrated in FIG. 6 the number of drive elements can be reduced. This is because between the groups one of the trigger electrodes is eliminated and not required. Also, in the arrangement illustrated in FIG. 11, the probability of erroneous scanning operation of the Y electrodes at the boundaries between the groups of the trigger electrodes slightly increases.

Figure 12:
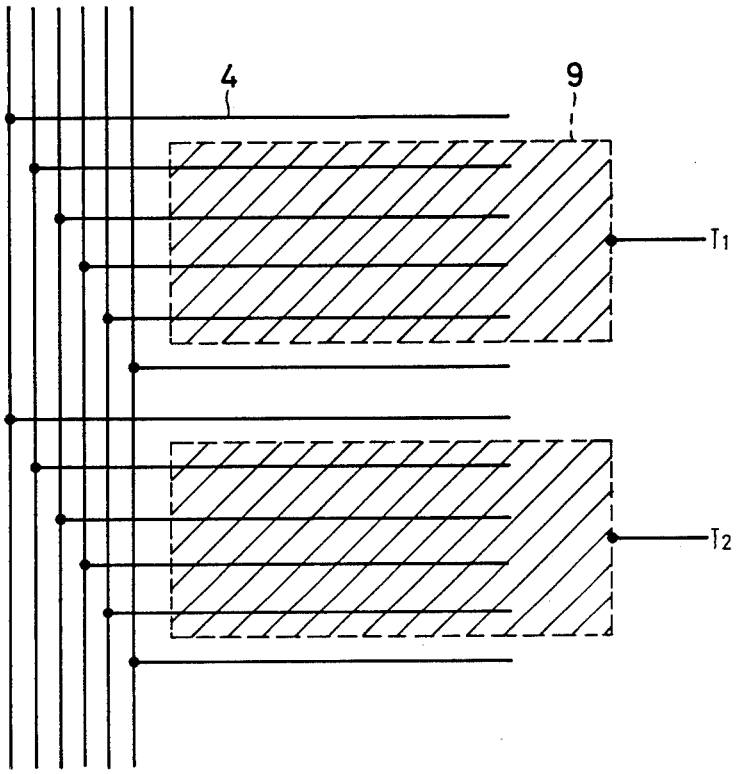
FIG. 12 illustrates another modification of the trigger electrodes.

FIG. 12 illustrates that the groups of trigger electrodes may comprise plate electrodes. As illustrated, the trigger electrode is arranged immediately below each of the cathode electrodes 4. The electric field will then concentrate at this portion upon application of the trigger voltage. For this reason, the higher trigger voltage must be applied in order to cause triggering at the space beside the cathode electrode 4. This means that the dielectric strength of the insulating layer must be improved. FIG. 12 illustrates an example where the separation bands are formed between each pair of adjacent plate electrodes of the trigger electrodes as illustrated in FIG. 11. However, plate electrodes may also be used in the arrangement which does not include separation bands.

Figure 13:
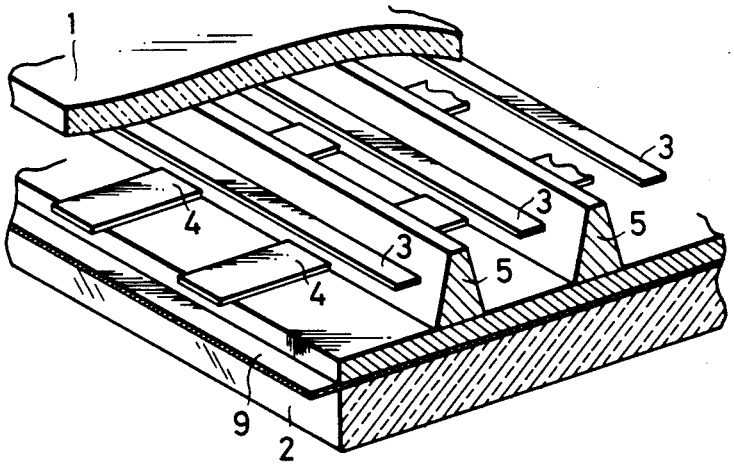
FIG. 13 is a broken away perspective view of a discharge display panel illustrating yet another modification of the trigger electrodes.

FIG. 13 is a partially broken away perspective view of a discharge display panel which illustrates another modification of a trigger electrode. According to this modification, the trigger electrodes 9 are not grouped but comprise a single plate electrode which covers the entire display region and which is mounted between plates 2 and 8.

Figure 14:
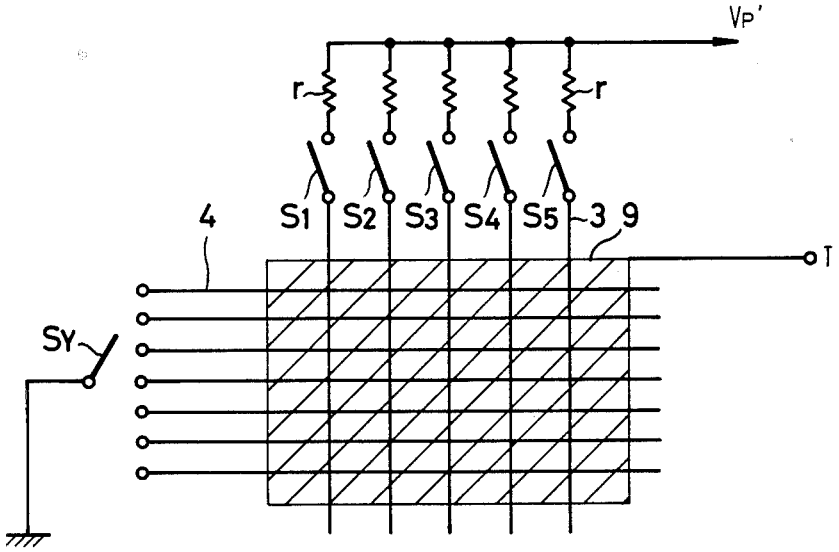
FIG. 14 is a circuit diagram of a drive circuit of the display panel illustrated in FIG. 13.

FIG. 14 comprises a circuit diagram for the drive circuit for driving the plate electrode illustrated in FIG. 13. As shown in FIG. 14, since the cathodes 4 cannot be grouped individual cathode driving lines are selectably driven through a switch $S_Y$. Therefore, the number of drive elements for the Y electrodes will not be reduced. However, the anode voltage may be lowered in this arrangement.

Figure 15:
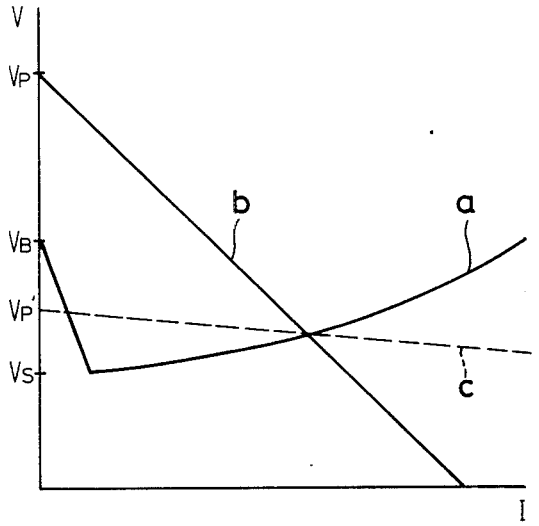
FIG. 15 is a graph showing the discharge characteristics of the discharge display panel illustrated in FIG. 14.

As illustrated in FIG. 15, a conventional discharge element has a discharge start voltage $V_B$ and a discharge maintaining voltage $V_S$ as illustrated by a discharge characteristic curve a. The intersection of the curve a with the voltage application characteristic curve b defines a discharge working point. Since there are variations in the discharge start voltage $V_B$ and the discharge maintaining voltage $V_S$, the anode voltage (power source voltage) $V_P$ must be higher than $V_B$. On the other hand, in the embodiment illustrated in FIG. 14, the discharge may be effected by applying a voltage corresponding to $V_P$ to the trigger electrode 9. Therefore, an anode voltage $V_P'$ need only be high enough to maintain the discharge operation or to be slightly higher than $V_S$. Thus the anode voltage can be dropped from $V_P$ to $V_P'$ or an amount from about 50 to 100 volts. For this case, the anode voltage has a voltage application characteristic curve c illustrated in FIG. 15.

Due to the fact that the applied voltage is substantially reduced over the prior art, the breakdown voltage requirement for the switching transistors for driving the anodes 3 can be lowered resulting in lower manufacturing cost. Although the drive element for the trigger electrodes 9 must have a relatively high voltage breakdown, the manufacturing cost of the circuit will not be significantly increased since only one such drive element is required.

Figure 16:
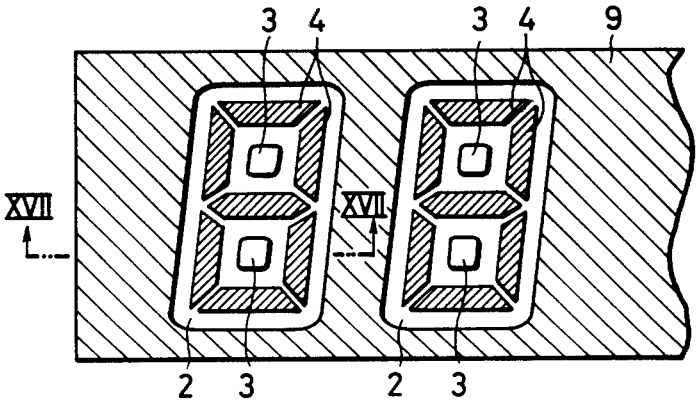
FIG. 16 is a plan view of a numerical discharge display panel according to another embodiment of the present invention.
Figure 17:
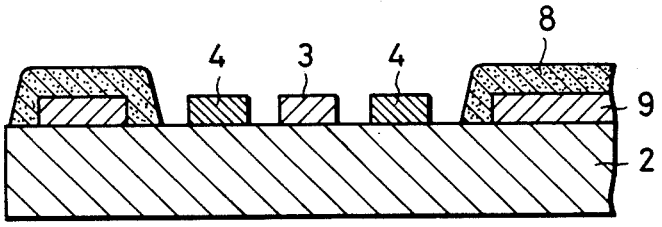
FIG. 17 is a partially sectional view of the panel illustrated in FIG. 16.

FIGS. 16 and 17 illustrate another embodiment of the present invention wherein FIG. 16 is a plan view of a numerical discharge display panel having seven segments and FIG. 17 is a partial sectional view. Seven display segments for constituting a numeral between 0 and 9 or the cathodes 4 and surround the anode electrodes 3. The trigger electrode 9 with the insulating layer 8 covering them surround the display segments or cathodes 4. The anodes 3, cathodes 4 and the trigger electrode 9 are flatly mounted on the surface of the rear plate 2. The triggering discharge operation by the trigger electrodes 9 is the same as in the embodiments discussed previously.

The present invention may be applicable to discharge display panels of an AC voltage driven type. In this case, an AC voltage is applied across the X and Y electrodes which respectively correspond to the cathodes and anodes. The trigger electrodes may be used for triggering for the purpose of reducing the number of driving elements for scanning in the Y direction as in the embodiments mentioned above.

According to the present invention, pairs of discharge electrodes are arranged with a discharge gap therebetween and a X-Y matrix. A trigger electrode for triggering discharge operation is arranged beside one of the pair of discharge electrodes under the insulating layer. Therefore, the number of driving elements can be significantly reduced by a combination of the scanning electrodes and the many phases of the voltage for driving the one of the pair of discharge electrodes. Since the trigger electrodes and the discharge electrodes are capacitively coupled through the insulating layer, the discharge operation can be instantaneously effected by the trigger electrode, thus resulting in less interference of the display. The display discharge voltage may be lowered by triggering discharge operation so that the drive circuit can be manufactured at low cost.

Since the display discharge occurs in a stable manner by a triggering discharge operation, the discharge delay time may be shortened and may be made uniform. Thus, the display device will have less flicker and good response. Since the structure is simple, a display device can be manufactured at low cost and with high resolution.

Although the invention has been described with respect to preferred embodiments, it is not to be so limited as changes and modifications can be made which are within the full intended scope of the invention as defined by the appended claims.

I claim as my invention:

1. A flat panel display apparatus comprising, first and second insulating plates with at least one of said plates being transparent, a first plurality of parallel electrodes mounted on one side of said first plate, a second plurality of parallel electrodes with at least one of said second electrodes mounted on one side of said second plate and covered with an insulating layer, a third plurality of parallel electrodes mounted on said insulating layer and extending at an angle other than zero to said first electrodes, said first electrodes spaced from and opposed to said third electrodes to define a cross conductor matrix for locating glowing regions, a plurality of parallel insulating barriers mounted on said first plate to extend parallel between said first electrodes extending toward said insulating layer on said second plate, said first and second plates with their outer edges sealed and a gas capable of glowing within the envelope formed between said plates, means for simultaneously applying trigger and sequence pulses during a horizontal scanning period to said at least one of said second electrodes and said third electrodes respectively, to cause a temporary discharge therebetween, and means for applying display signals during the same horizontal scanning period to at least one of said first electrodes not earlier than said trigger pulses and said sequence pulses thereby to cause a glowing discharge in said envelope.

2. An apparatus according to claim 1, in which said second electrodes are commonly connected together to form a unitary structure electrode.

3. An apparatus according to claim 1, in which each of said second electrodes is mounted intermediately between a pair of said third electrodes.

4. An apparatus according to claim 1, in which the space between of said second electrodes is the same as the space between of said third electrodes.

5. An apparatus according to claim 1, in which said first electrodes are anodes, said second electrodes are triggering electrodes and said third electrodes are cathodes.

6. A flat panel display apparatus comprising, first and second insulating plates with at least one of said plates being transparent, a first plurality of parallel electrodes mounted on one side of said first plate, a second plurality of parallel electrodes with at least one of said second electrodes mounted on one side of said second plate and covered with an insulating layer, a third plurality of parallel electrodes mounted on said insulating layer and extending at an angle other than zero to said first electrodes, said first electrodes spaced from and opposed to said third electrodes to define a cross conductor matrix for locating glowing regions, a plurality of parallel insulating barriers mounted on said first plate to extend parallel between said first electrodes extending toward said insulating layer on said second plate, said first and second plates with their outer edges sealed and a gas capable of glowing within the envelope formed between said plates, means for simultaneously applying trigger and sequence pulses during a horizontal scanning period to said at least one of said second electrodes and said third electrodes respectively, to cause a temporary discharge therebetween, and means for applying display signals during the same horizontal scanning period to at least one of said first electrodes not earlier than said trigger pulses and said sequence pulses thereby to cause a glowing discharge in said envelope, in which each of said second electrodes is mounted intermediately between a pair of said third electrodes, and in which n adjacent ones of said second electrodes are commonly connected together to form a plurality of groups of said second electrodes, certain ones of said third electrodes also commonly connected together.

7. An apparatus according to claim 6 in which every said n adjacent ones of said second electrodes form a unitary structure electrode.

8. A display apparatus comprising a sealed envelope with at least one side transparent, a gas capable of glowing within said envelope, a plurality of parallel extending anode electrodes mounted in said envelope in a first plane, a plurality of parallel extending cathode electrodes mounted in said envelope in a second plane and extending substantially ninety degrees to said anode electrodes, means for applying driving voltage during a horizontal scanning period to selected cathode electrodes, at least one trigger electrode mounted in said envelope and mounted near said cathode electrodes so as to periodically initiate invisible discharge between said trigger and adjacent selected cathode electrodes, and means for applying driving voltages during the same horizontal scanning period to selected ones of said anodes, said selected cathode, and said selected trigger electrodes being driven at the same time to cause glowing discharge in said envelope.

9. A display apparatus comprising a sealed envelope with at least one side transparent, a gas capable of glowing within said envelope, a plurality of parallel extending anode electrodes mounted in said envelope in a first plane, a plurality of parallel extending cathode electrodes mounted in said envelope in a second plane and extending substantially ninety degrees to said anode electrodes, a plurality of parallel extending trigger electrodes mounted in said envelope and mounted near said cathode electrodes so as to periodically initiate invisible discharge between certain electrodes, m adjacent trigger electrodes connected together to form different groups of trigger electrodes certain of said cathode electrodes mounted adjacent one of said groups of trigger electrodes and commonly connected together to form different groups of cathode electrodes and means for applying driving voltages during the same horizontal scanning period for driving selected ones of said anode electrodes and to said groups of cathode electrodes and to one of said groups of trigger electrodes to cause multiphase glow discharge in said envelope.

10. A display apparatus according to claim 9 wherein the ratio of n to m is two.

11. A display apparatus according to claim 9 wherein the number of driving elements for said cathode and trigger electrodes is equal to $E=j+i/2$ where j is equal to the number of phases of said driving voltages applied to the cathode electrodes and i is the total number of groups of trigger electrodes.

12. A display apparatus according to claim 9 wherein between two groups of trigger electrodes a separation zone is formed.

13. A display apparatus according to claim 9 wherein said m adjacent trigger electrodes form a unitary structure electrode.

14. A display apparatus comprising a sealed envelope with at least one side transparent, a gas capable of glowing within said envelope, a plurality of parallel extending anode electrodes mounted in said envelope in a first plane, a plurality of parallel extending cathode electrodes mounted in said envelope in a second plane and extending substantially ninety degrees to said anode electrodes, means for applying driving voltage during the same horizontal scanning period to selected cathode electrodes, a plurality of parallel trigger electrodes mounted in said envelope and extending in the same direction as said cathode electrodes and mounted near said cathode electrodes so as to periodically initiate invisible discharge between selected trigger and cathode electrodes, with one trigger electrode for two cathode electrodes and respectively mounted therebetween, adjacent m trigger electrodes connected together to form m groups of trigger electrodes, certain of said cathode electrodes mounted adjacent one of said groups of trigger electrodes and commonly connected together to form different groups of cathode electrodes and means for applying driving voltages during a horizontal scanning period for driving selected ones of said anode electrodes and to said groups of cathodes and to one of said groups of trigger electrodes.

* * * * *